United States Patent [19]
Wride
[11] 4,113,234
[45] Sep. 12, 1978

[54] HYDRAULIC JACKS

[76] Inventor: Donald Charles Wride, 35 Helen Ter., Valley View, South Australia, Australia, 5093

[21] Appl. No.: 841,723

[22] Filed: Oct. 13, 1977

[30] Foreign Application Priority Data

Oct. 18, 1976 [AU] Australia ..... PC7765

[51] Int. Cl.[2] ..... B66F 1/08
[52] U.S. Cl. ..... 254/108
[58] Field of Search ..... 254/1, 108–110

[56] References Cited

U.S. PATENT DOCUMENTS

| | | | |
|---|---|---|---|
| 2,205,691 | 6/1940 | Johnson | 254/108 |
| 2,527,428 | 10/1950 | Kemerer | 254/93 H |
| 2,657,009 | 10/1953 | Neis et al. | 254/109 |
| 3,881,687 | 5/1975 | Johansson | 254/108 |

*Primary Examiner*—Robert C. Watson
*Attorney, Agent, or Firm*—J. Harold Nissen

[57] ABSTRACT

A hydraulic jack support having a pair of telescopic members, one being a base and the other a bridge movable on the base, and an adjustable platform for supporting a jack engaging the base but adjustable thereon in height whereby the lifting jack is positioned on to the platform to lift the bridge in relation to the said platform and whereby the said platform can be raised for a multistage lift.

10 Claims, 8 Drawing Figures

HYDRAULIC JACKS

BACKGROUND OF INVENTION

This invention relates to improvements in and to hydraulic jacks, and in particular it relates to a support frame for a hydraulic jack which is lockable to support the load.

PRIOR ART

Hydraulic jacks according to the usual construction are so arranged that the jack must be positioned and operated to raise the load to the required height. The jack then remains in position to support the load and the jack is eventually lowered and removed, the jack thus being required while the load is supported.

It would be advantageous to be able to support the load without leaving the jack in place, and an object of this invention is to provide a mechanism for association with a jack which will achieve this.

It is a further object to increase the height to which a load can be raised by means of a standard jack.

It is a still further object to increase the rate of operation of a jack by having dual speed of lift which is actuated by the load.

This and other objects will be apparent from the description of the invention.

SUMMARY OF INVENTION

According to this invention the jack has associated with it a support frame which in use carries the jack but which supports the load so that the jack is used merely for raising and lowering the load, and a jack, for instance a hydraulic jack, can be removed while the support frame carries the load until the jack is again used to lower the load.

The jack support according to this invention comprises a pair of telescopic members, one of the telescopic members comprising a base plate and upstanding support means, the other member comprising a bridge and guide means, the guide means engaging the support means to guide the bridge toward and away from the base. A platform which supports a jack engages the support means to be movable along the support means to be variable in distance from the base, means being provided to lock the platform to the support means at a selected height, and there are also means to lock the guide means of the bridge to the support means, whereby the lifting jack can be positioned on the platform to have the lifting ram of the jack engage the bridge to raise and lower it in relation to the platform to give a multi-stage lift.

The locks for the platform and the bridge are preferably arranged to lock against movement in the direction of the said base plate only but are releasable.

In order however that the invention can be fully understood embodiments thereof will now be described with reference to the accompanying drawings.

DESCRIPTION OF THE PREFERRED EMBODIMENT

Figure 1:
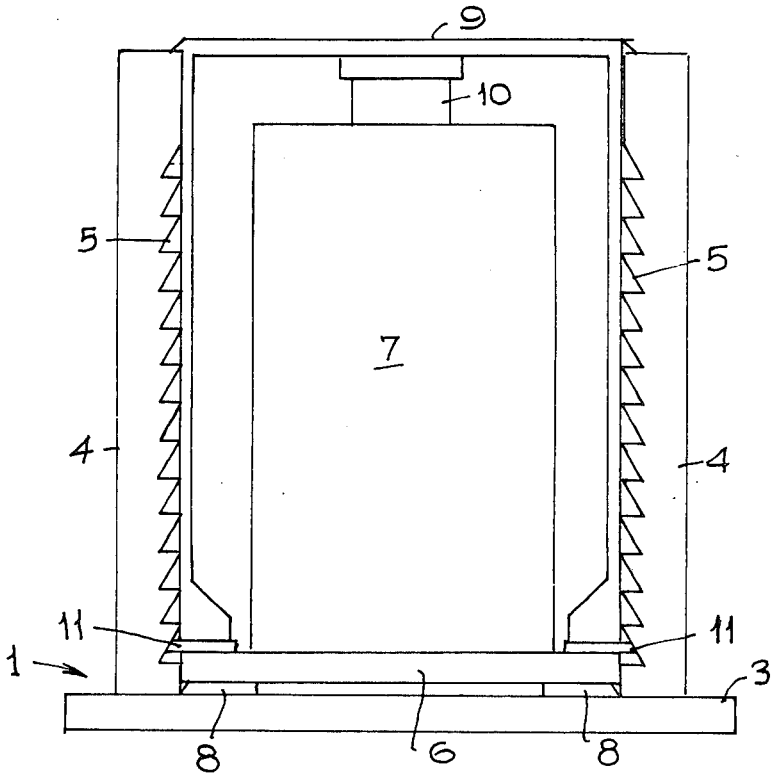
FIGS. 1, 2, 3 and 4 show schematically how a jack and a supporting frame according to this invention can give different amounts of lift and leave the jack free so that it can be removed for other use, it being possible to provide a series of such support frames to be used with a common jack.

The means for supporting the jack comprise a pair of members 1 and 2 which are telescopic, the member 1 having a base plate 3 which has a pair of upwardly projecting support bars 4 on it which have a series of notches 5 therein. These support bars 4 engage and support an adjustable platform 6 on which the jack 7 actually rests when in use, it being possible to situate this at different heights as the lift progresses by having detents 8 on it which are disposed to engage the notches 5.

The member 2 is moved upwardly by the jack as the member is guided on the support bars 4 and has a bridge 9 which is engaged by the ram 10 of the jack 7. The member 2 has detents 11 associated therewith in such a way that the removable base plate can first be positioned and the load then lifted by operating the jack to raise the bridge 9 which engages the load, and the member 2 and bridge will then lock in position allowing the jack to be retracted and removed, whereupon the load will be supported by the bridge 9 on the member 2.

Figure 2:
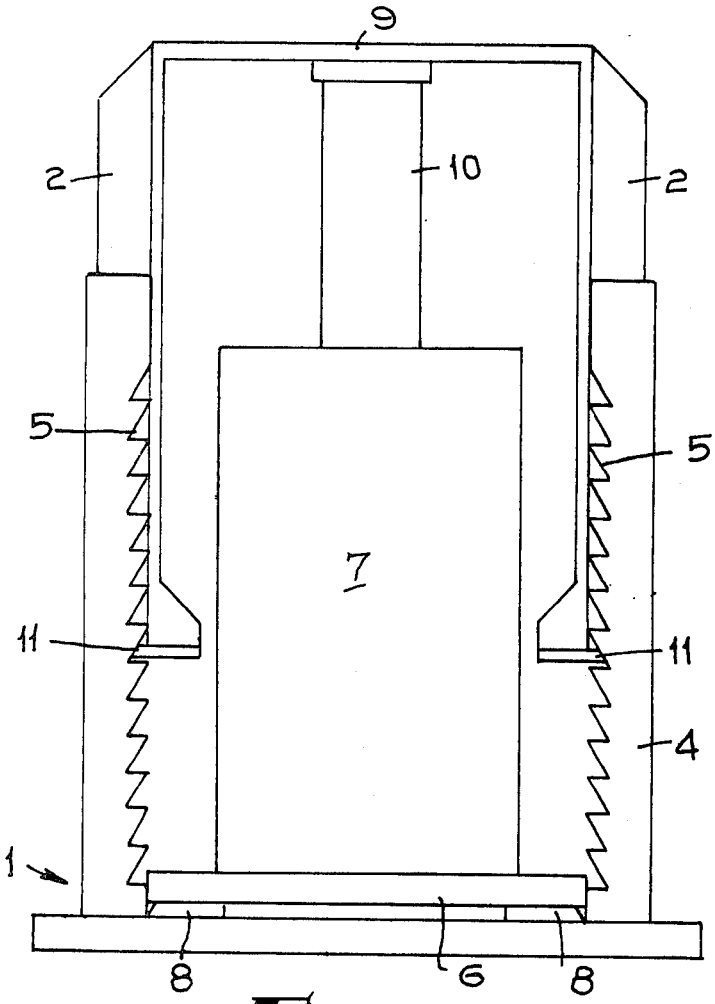

The first position prior to lift is shown in FIG. 1 and the position to which the load is lifted is shown in FIG. 2. The load will then be supported by the telescopic members 1 and 2, the detents 11 engaging the nearest of the notches 5 as the lift is released from the jack 7, the piston 10 of the jack being then retracted.

Figure 3:
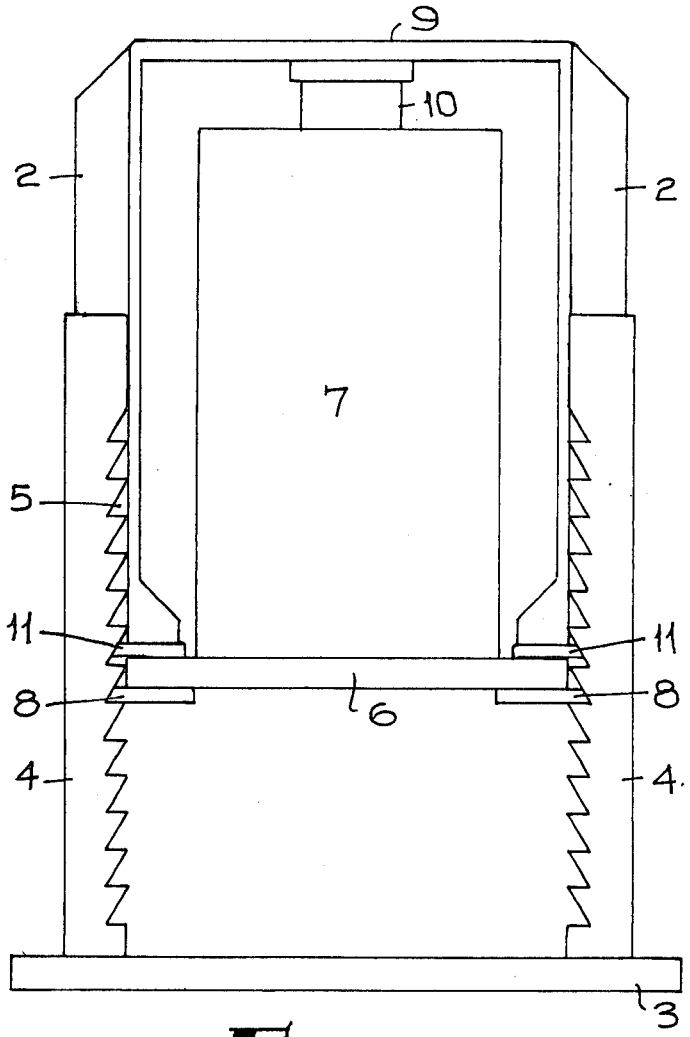
Figure 4:
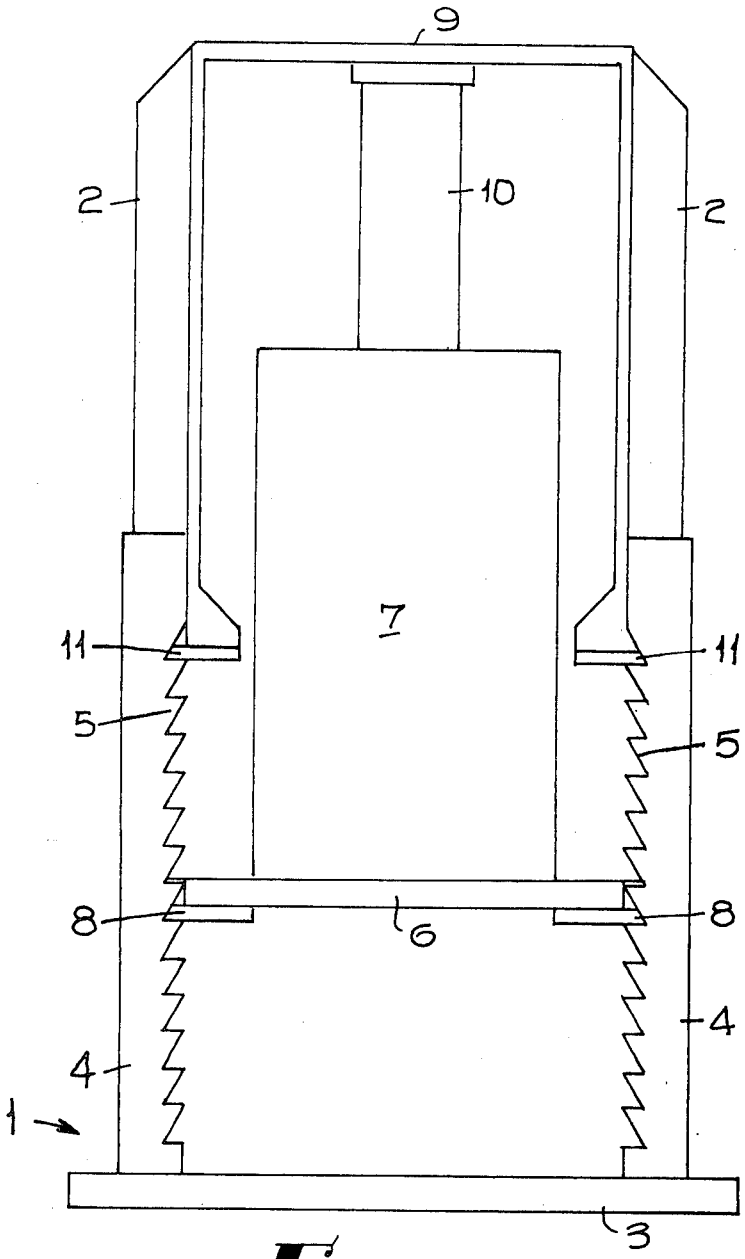
Figure 5:
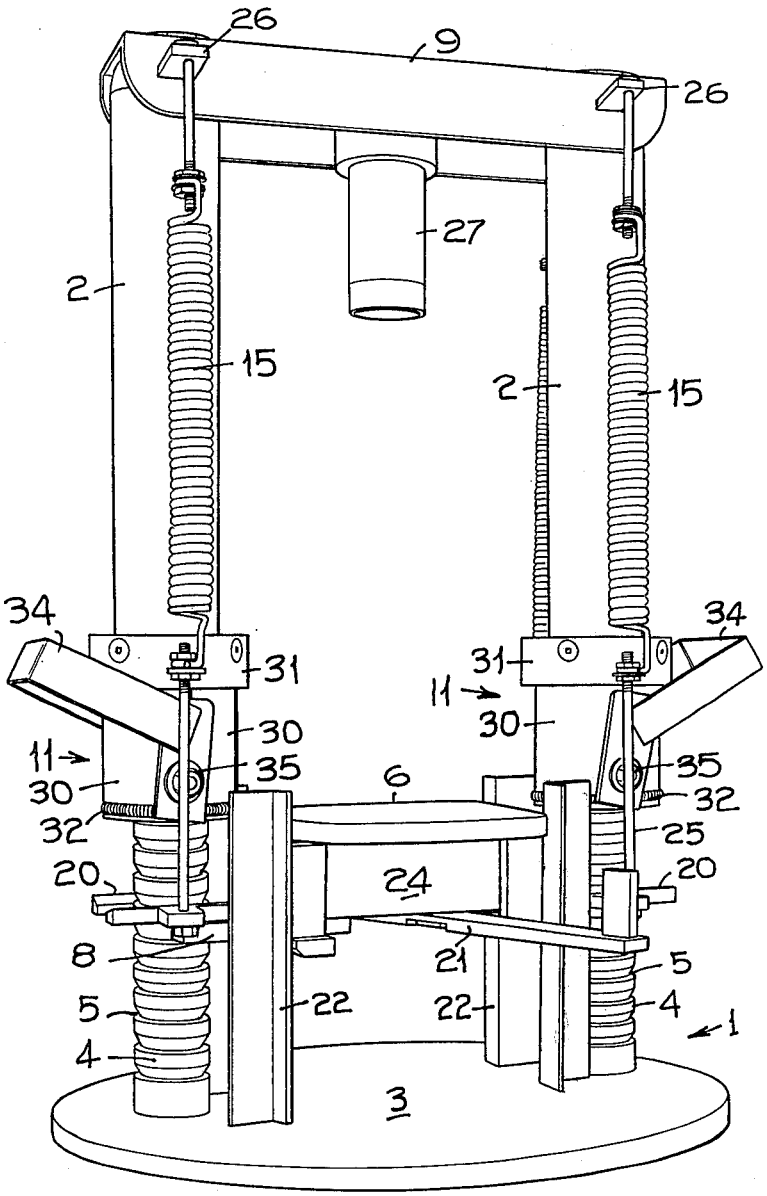
FIG. 5 is a perspective view of a jack support frame constructed according to the invention, the jack support frame being shown in extended position.
Figure 6:
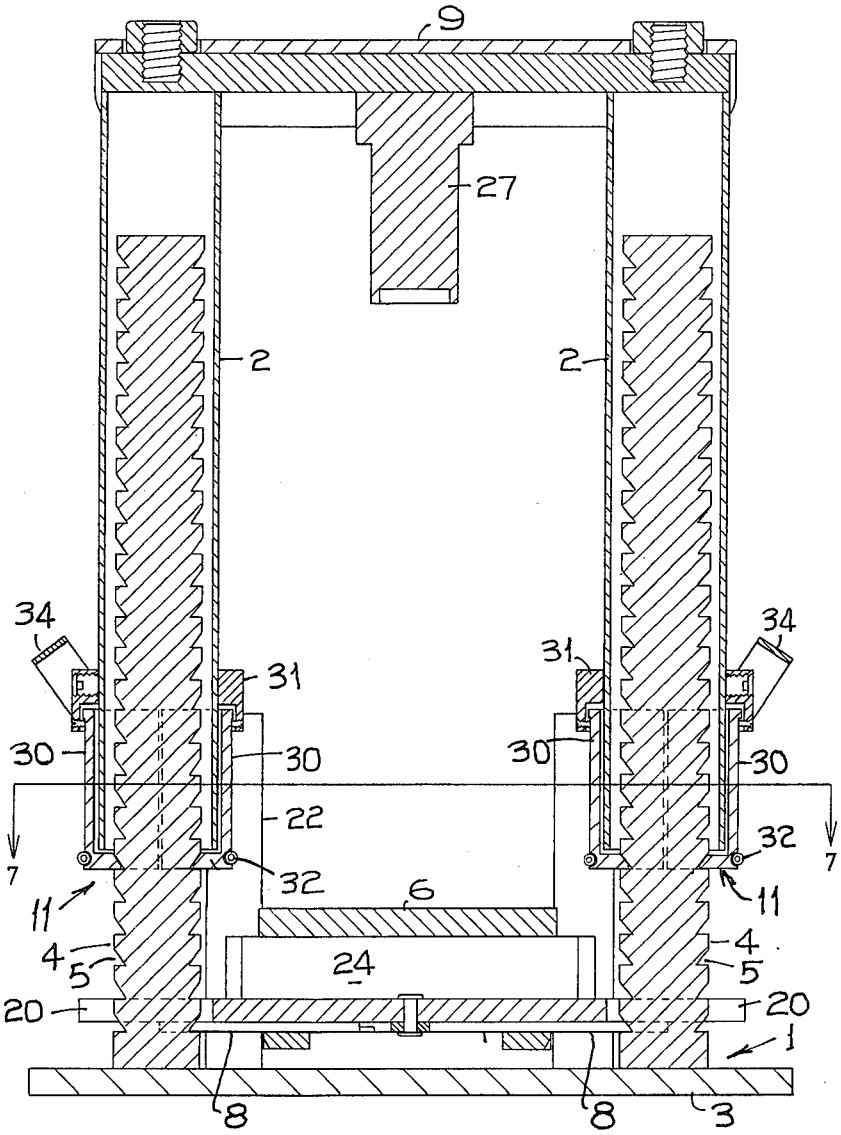
FIG. 6 is a transverse central section of same partly extended.
Figure 7:
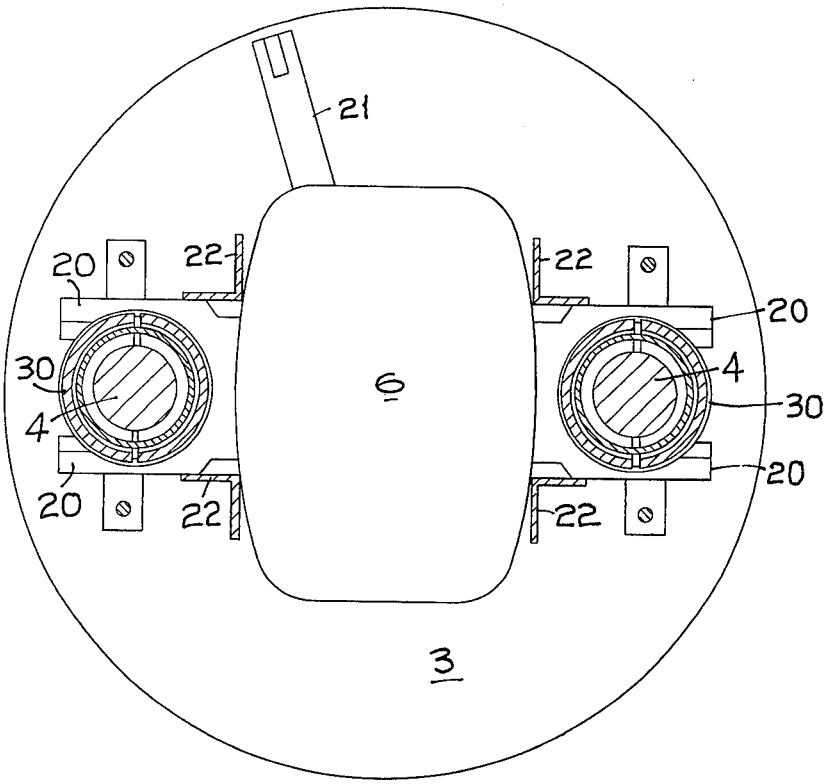
FIG. 7 is a section of same on line 7 — 7 of FIG. 6.

If the load is to be lifted to a new height the platform 6 is raised to the position shown in FIG. 3 and the jack with the piston lowered is placed on the platform 6 and when the jack is activated, the ram 10 will be extended to move the bridge 9 to the position shown in FIG. 4 where it will be held by the detents 11 engaging appropriate notches 5 in the support bars 4.

The ram 10 of the jack 7 can then be retracted and the load will be supported at the new level while the jack may be removed and used for other purposes such as with a further jack support.

Springs 15 pull the platform 6 toward the frame 2 so that unless prevented by the jack the platform 6 will be pulled against the bottom of the frame 2 in readiness for the next lift.

The detents 8 and 11 are provided with release means which pull them inwards to allow the platform 6 and the members 2 to be lowered when required.

Referring now particularly to FIGS. 5, 6, 7 and 8 it will be seen that the platform 3 has a guide frame 20 extending part-way around the support bars 4 which are of circular cross-section with the notches 5 extending around same, the detents 8 being positioned beneath the guide frame 20 so that the load is transferred from the platform 6 directly to the detents. The detents are connected to a release lever 21 which pulls them out of engagement with the support bars 4 when the platform is lowered. The posts 22 are merely added guides for the platform 6 which has a reinforcing frame 24 beneath it.

The guide frame 20 also has the lower ends of the springs 15 attached to it through rods 25, the upper ends of the springs engaging brackets 26 on the bridge 9.

The bridge 9 has a depending member 27 on it which engages the ram of the jack and if a jack of different size to that for which the frame is designed is used, this member 27 can be replaced by a member of different length.

The detents 11 are each formed by a split tubular member 30 which has the two halves of the member engaged in collars 31 on the member 2, each member 2 being of tubular form to encircle the support bars 4 and be guided thereby. The lower ends of the two parts of the tube 2 are turned in to form the actual engaging part of the detents 11 and the two parts are loaded into locking position by a spring circlip 32 but can be moved to swing the lower ends of the detents out to disengage from the notches of the support bars 4, a lever 34 with a cam 35 engaged between the two members of the split tubular member 30, thus allowing the detents to be released from the notched support bars 4.

Figure 8:
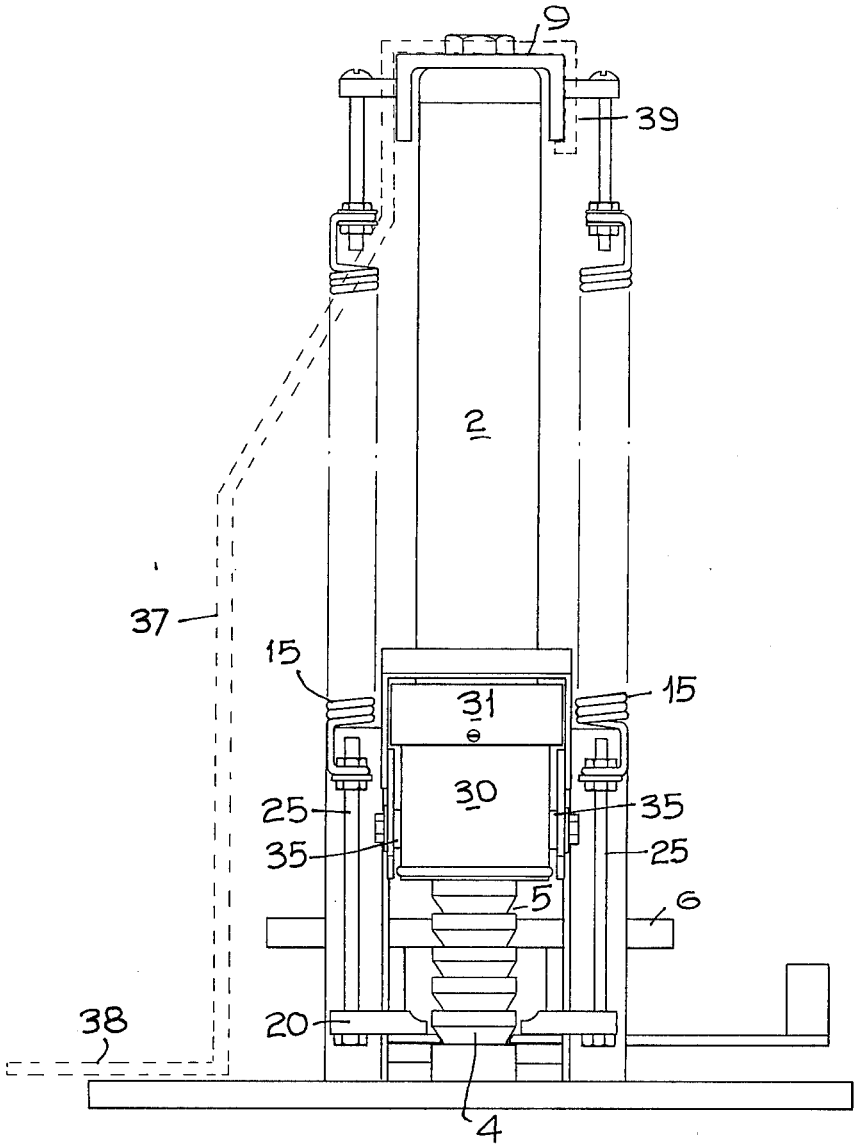
FIG. 8 is a side elevation of the jack support frame.

In FIG. 8 is shown how a lower lift point can be achieved by using a fork member 37 having a foot 38 and a part 39 which engages over the bridge 9.

If a higher lift is required the device can be extended to its full height and the load taken on a support and the device can itself then be placed in a support to continue the lift.

The device thus comprises a first member 1 with a base 3 which is adapted to contact the ground and has upstanding support members 4 and a second member 2 which is telescopically movable on the first member but is lifted by the jack 7 resting on a platform 6 engaging the first member so that the telescopic portion can be given a series of lifts by appropriately repositioning the removable base plate each time the jack has completed a lift.

With the use of such a device the jack merely forms the operating means for the device so that the telescopic section can first be retracted to its minimum height and the jack then inserted to rest on the platform and when actuated lifts the telescopic portion for the first lift, after which the telescopic section is locked in that position and the jack can have the ram 10 retracted and the removable platform 6 raised for the second stage lift and so on until the required height has been reached.

Such a device also has the advantage that a number of these relatively simple jack support devices can be supplied with a single jack as once the telescopic member has been extended to lift a load, it will remain locked in position and the jack can be removed and associated with a second jack support which can then effect the required lift, and so on, thus enabling a single lifting jack to be used with a number of telescopic jack support members which will support the load at the height to which it was raised.

To lower the device it is only necessary to insert the jack 7 into the device and to disengage the detents after the weight has been taken by the jack, and to then lower the telescopic section by a required amount, whereupon the spring loaded detents of the telescopic section are again engaged to allow the base plate 6 to be lowered to its next position.

Instead of forming the jack support as illustrated it may comprise a tubular inner member attached to the base plate with grooves cut through the sides and open to the front to receive the jack. Over the outside is another tubular member open in front slidable with spring loaded wedges at the lower end. The platform inside the jack stand could be slidable in the inner member using spring loaded wedges and using the same grooves as the outer member. The platform could be spring loaded so that when released it would pull the platform up to reposition the jack.

Any form of jack may be used.

I claim:

1. A hydraulic jack support for a jack which is independent of the support comprising:

a pair of telescopic members, one of said telescopic members comprising a base plate and spaced upstanding support means secured to said base, the other said member comprising a bridge and guide means, said guide means engaging said support means to guide said bridge toward and away from said base;

a platform for supporting a jack disposed between said base and said bridge engaging said support means to be movable along said support means to be variable in distance from said base;

means to lock said platform to said support means;

means to lock said bridge and guide means to said support means;

means to release said lock means; and, spring means connected between said bridge guide means and said platform whereby to urge said platform toward said bridge, whereby an independent lifting jack can be positioned on said platform to have the lifting ram of said jack engage said bridge in relation to said platform and whereby said platform is raised by said spring means for a multi-stage lift.

2. A hydraulic jack support as claimed in claim 1 wherein said locks for the said platform and the said bridge lock only against movement in the direction of movement the said base plate.

3. A hydraulic jack support as claimed in claim 2 wherein said locks for the said platform are saw-toothed notches engaged by spring-loaded detents on the said platform and the said bridge guide means.

4. A hydraulic jack support as claimed in claim 1, wherein said upstanding supports have a series of notches formed thereon and the said means to lock the said platform and the said bridge guide means to the said support means each have detents which engage the said notches, the said notches being shaped to allow the said detents to move freely in a direction away from the base but prevent movement toward the said base excepting when the said detents are released from engagement with the said notches.

5. A hydraulic jack support, comprising:

a pair of telescopic members, one of said telescopic members comprising a base plate and spaced apart upstanding support means having notches thereon, the other of said members comprising a bridge and guide means, said guide means being of tubular form and encircling said support means to guide the bridge toward and away from said base;

a platform for supporting a jack disposed between said support means and engaging said support means to be movable along said support means to be variable in distance from said base;

detents on said platform to engage said notches on said support means;

detents on said guide means to engage said notches on said support means;

means to release each of said detents;

and means to lift said base whereby said lifting jack can be positioned on said platform to have the lifting ram of said jack engage and lift said bridge in relation to said platform and whereby said platform can be raised for a multi-stage lift.

6. A hydraulic jack support as claimed in claim 5, cluding:

spring means connected between said bridge guide means and said platform for urging said platform toward said bridge.

7. A hydraulic jack support, comprising:

a pair of telescopic members, one of said telescopic members comprising a base plate and spaced apart upstanding support means having circumferential notches thereon of saw-tooth shape, the other said member comprising a bridge and guide means, said guide means being of tubular form and encircling said support means to guide the bridge toward and away from said base;

a platform for supporting a jack disposed between said support means and engaging said support means to be movable along said support means to be variable in distance from the said base;

spring loaded detents on said platform to engage said circumferential notches on said support means;

detents on said guide means encircling said support means and arranged to engage said circumferential notches on said support means, and means to release said detents, whereby said lifting jack can be positioned on said platform to have the lifting ram of said jack engage and lift said bridge in relation to said platform and whereby said platform can be raised for a multi-stage lift.

8. A hydraulic jack support as claimed in claim 7, cluding:

spring means connected between said bridge guide means and said platform for urging said platform toward said bridge whereby said platform is raised by said spring means for the multi-stage lift.

9. A hydraulic jack support comprising:

a pair of telescopic members, one of said telescopic members comprising a base plate and a pair of upstanding support means spaced apart and having circumferential notches thereon of saw-tooth shape, the other said member comprising a bridge and guide means, said guide means being of tubular form and encircling said support means to guide the bridge toward and away from said base;

a platform for supporting a jack having locating members engaging said support means to be movable along the support means to be variable in distance from said base and disposed between said support means;

spring loaded detents on said platform positioned beneath said locating members to engage said circumferential notches on said support means, whereby the locating members rest on said detents;

detents on said guide means encircling said support means and arranged to engage said circumferential notches on said support means, said detents comprising a split tubular assembly held in engagement with said notches by spring means; and, means to release said detents, whereby said lifting jack can be positioned on said platform to have the lifting ram of said jack engage and lift said bridge in relation to said platform and whereby said platform can be raised for a multi-stage lift.

10. A hydraulic jack support as claimed in claim 9, including:

spring means connected between said bridge guide means and said platform toward said bridge thereby permitting said spring means to raise said platform.

* * * * *